US012138682B2

(12) United States Patent
Grasset-Bourdel et al.

(10) Patent No.: US 12,138,682 B2
(45) Date of Patent: Nov. 12, 2024

(54) EXCHANGEABLE NOZZLE FOR A NOZZLE CHANGER SYSTEM, A METHOD FOR MANUFACTURING SUCH A NOZZLE, A NOZZLE CHANGER SYSTEM COMPRISING SUCH A NOZZLE AND A TUNDISH COMPRISING SUCH A NOZZLE CHANGER SYSTEM

(71) Applicant: REFRACTORY INTELLECTUAL PROPERTY GMBH & CO. KG, Vienna (AT)

(72) Inventors: Renaud Grasset-Bourdel, Trofaiach (AT); Martin Wiesel, Trofaiach (AT); Neha Jain, Leoben (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 169 days.

(21) Appl. No.: 17/772,611

(22) PCT Filed: Sep. 3, 2020

(86) PCT No.: PCT/EP2020/074653
§ 371 (c)(1),
(2) Date: Apr. 28, 2022

(87) PCT Pub. No.: WO2021/104696
PCT Pub. Date: Jun. 3, 2021

(65) Prior Publication Data

US 2023/0001472 A1 Jan. 5, 2023

(30) Foreign Application Priority Data

Nov. 26, 2019 (EP) ..... 19211449

(51) Int. Cl.
*B22D 11/06* (2006.01)
*B22D 41/54* (2006.01)

(52) U.S. Cl.
CPC ..... *B22D 11/0642* (2013.01); *B22D 41/54* (2013.01)

(58) Field of Classification Search
CPC ..... B22D 11/0642; B22D 41/50; B22D 41/54
See application file for complete search history.

(56) References Cited

U.S. PATENT DOCUMENTS 4,835,123 A 5/1989 Bush et al.
5,186,886 A * 2/1993 Zerinvary ..... B22D 41/54 266/237
6,156,446 A 12/2000 Brueckner et al.

FOREIGN PATENT DOCUMENTS

CN 1905970 A 1/2007
EP 3381587 A1 10/2018
EP 3409399 A1 12/2018
(Continued)

OTHER PUBLICATIONS

Machine translation of CN 1905970 A (Year: 2007).*
(Continued)

*Primary Examiner* — Kevin E Yoon
(74) *Attorney, Agent, or Firm* — Calfee, Halter & Griswold LLP

(57) ABSTRACT

The invention concerns an exchangeable nozzle for a nozzle changer system for billet casting, a method for manufacturing such a nozzle, a nozzle changer system comprising such a nozzle and a tundish comprising such a nozzle changer system.

14 Claims, 8 Drawing Sheets

(56) References Cited

FOREIGN PATENT DOCUMENTS

| | | | | |
|---|---|---|---|---|
| FR | 0106739 | A1 * | 4/1984 | |
| JP | H06226431 | B2 | 8/1994 | |
| KR | 2016064626 | A * | 6/2016 | |
| WO | WO-2009072216 | A1 * | 6/2009 | ..... B22D 11/10 |
| WO | 2021104696 | A1 | 6/2021 | |

OTHER PUBLICATIONS

International Search Report, PCT Publication No. WO2021104696. Mar. 6, 2021. 4 pages.
Written Opinion of the International Search Authority, PCT Publication No. WO2021104696, Mar. 6, 2021. 6 pages.
"Office Action for Chinese Patent Application No. 202080074131.8", Mailed Date: Feb. 15, 2023, 29 pages.
Hongxia, Li, "Functional Refractories for Modern Metallurgy", Metallurgical Industry Press, 1st Edition, Feb. 28, 2019, pp. 721-724.
"Examination Report for Vietnamese Patent Application No. 1-2022-02449", Mailed Date: Feb. 27, 2024, 2 pages.

* cited by examiner

EXCHANGEABLE NOZZLE FOR A NOZZLE CHANGER SYSTEM, A METHOD FOR MANUFACTURING SUCH A NOZZLE, A NOZZLE CHANGER SYSTEM COMPRISING SUCH A NOZZLE AND A TUNDISH COMPRISING SUCH A NOZZLE CHANGER SYSTEM

The invention concerns an exchangeable nozzle for a nozzle changer system for billet casting, a method for manufacturing such a nozzle, a nozzle changer system comprising such a nozzle and a tundish comprising such a nozzle changer system.

In billet casting, especially in open casting, molten metal, in particular a steel melt, is provided in a tundish of a continuous casting plant. An outlet is provided at the bottom of the tundish through which the molten metal provided in the tundish can be discharged into a mould located below the tundish. In the mould, the molten metal solidifies into a billet.

Such outlets at the bottom of a tundish in continuous billet casting are known as metering nozzles. These nozzles regulate the flow rate of the molten metal flowing from the tundish into the mould.

Such metering nozzles are also known as nozzle changer systems. Such nozzle changer systems include a first nozzle that is permanently installed in the bottom of the tundish. This first nozzle, fixed in the bottom of the tundish, is known as the "upper nozzle". Such an upper nozzle regularly comprises a refractory component in which a tubular member is embedded. The upper nozzle is arranged at the bottom of the tundish in such a way that molten metal can flow through the tubular member. In practice, this tubular member of an upper nozzle is regularly referred to as an "insert".

In addition to the upper nozzle, a nozzle changer system also comprises an exchangeable nozzle, which also comprises a tubular member, which in practice is also regularly referred to as an "insert". In practice, such an exchangeable nozzle is also referred to as a "flying nozzle".

The tubular member of the exchangeable nozzle is also regularly embedded in a refractory material, in particular a ceramic refractory material.

In a nozzle changing system, the exchangeable nozzle can be connected to the upper nozzle in such a way that the tubular member of the upper nozzle and the tubular member of the exchangeable nozzle form a continuous channel through which molten metal can be discharged from the tundish.

The use of such a nozzle changer system in a tundish for continuous casting has the particular advantage that the exchangeable nozzle can be released from its connection to the upper nozzle and replaced by a new exchangeable nozzle, for example in the event of wear of the exchangeable nozzle or if an exchangeable with another diameter of the nozzle channel is required. In practice, a nozzle changer is used to connect the exchangeable nozzle on the upper nozzle block and to release it from the upper nozzle. Such nozzle changers of nozzle changer systems are devices, in particular mechanical devices, which can also be operated hydraulically.

In principle, such nozzle changer systems have proven themselves in practice.

However, the inventors of the invention of the present application have discovered that in such nozzle changer systems, a gap may be formed between the upper nozzle and the exchangeable nozzle, while molten metal flows through the upper nozzle and the exchangeable nozzle connected to it. However, this allows molten metal to be drawn into the gap, which may solidify in the gap. However, this solidified metal between the upper nozzle and the exchangeable nozzle can obstruct the movement between the upper nozzle and the exchangeable nozzle and in some cases even block the nozzle changer system.

The invention is based on the object of providing an exchangeable nozzle for a nozzle changer system, which can reduce the occurrence of a gap between the exchangeable nozzle and the upper nozzle during the casting of molten metal.

Furthermore, the invention is based on the object of providing a process for manufacturing such a nozzle.

A further object of the invention is to provide a nozzle changer system comprising such a nozzle.

Finally, a further object of the invention is to provide a tundish comprising such a nozzle changer system.

In order to solve the problem, an exchangeable nozzle for a nozzle changer system for billet casting is provided, said exchangeable nozzle comprising the following:

A tubular member;

said tubular member extending along a longitudinal axis from a first end of said tubular member to a second end of said tubular member;

said tubular member further comprising:

an inner passageway, extending through said tubular member along said longitudinal axis from said first end of said tubular member to said second end of said tubular member;

an inlet, opening into said inner passageway at said first end of said tubular member; and an outlet, opening into said inner passageway at said second end of said tubular member;

said tubular member consisting of partially stabilized sintered zirconia;

said partially stabilized sintered zirconia being partially stabilized by MgO; and said partially stabilized sintered zirconia having a degree of stabilization not above 26% by mass;

said tubular member comprising free carbon.

The invention is based on the basic finding that the formation of the gap between the exchangeable nozzle and the upper nozzle in a nozzle changer system during the casting of a molten metal is due to the fact that the tubular member of the exchangeable nozzle is subject to a substantial change in volume. This change in volume is due to the fact that the tubular member in exchangeable nozzles consists of zirconium dioxide (i.e. zirconia, $ZrO_2$). However, it is well known that zirconium dioxide is present in various modifications depending on the temperature, namely a monoclinic low-temperature modification, which at 1,170° C. first changes to the tetragonal and at 2,370° C. to the cubic high-temperature modification. These modifications are reversible when these temperatures are exceeded or deceeded. At the same time zirconium dioxide is present in the three modifications with a different density, so that the phase transformations of the zirconium dioxide are associated with a sudden, extreme change in volume when the temperatures exceed or fall below the mentioned temperatures what is also known as the "anomalous thermal expansion" of zirconium dioxide.

In accordance with the invention, it has now been established that the formation of the gap between the exchangeable nozzle and the upper nozzle is caused by this anomalous thermal expansion of the zirconium dioxide, insofar as the tubular member of the exchangeable nozzle consists of zirconium dioxide.

In the state of the art it is known to stabilize the tetragonal and especially cubic high temperature modification of zirconium dioxide by doping the zirconium dioxide with oxides such as CaO, MgO, $Y_2O_3$ or $Ce_2O_3$. This allows the tetragonal and cubic high temperature modification to be maintained up to room temperature, so that the anomalous thermal expansion of the zirconium dioxide due to a phase transformation can be reduced or even completely suppressed during heating and cooling.

It is known from the state of the art to completely stabilize zirconium dioxide by these doping oxides and to stabilize zirconium dioxide as fully stabilized zirconia (FSZ) or to only partially stabilize zirconium dioxide and to provide zirconium dioxide as partially stabilized zirconia (PSZ). However, the inventors found out that a tubular member consisting of fully stabilized zirconia is disadvantageous in an exchangeable nozzle for two reasons. The first reason is that fully stabilized zirconia requires higher amounts of the above identified stabilizing oxides such as CaO, MgO, $Y_2O_3$ or $Ce_2O_3$ which, however, deteriorate the refractory properties of the tubular member, especially its corrosion resistance. Further, even though fully stabilized zirconia does not show an anomalous thermal expansion, the thermal expansion (i.e. the usual change in volume of every object which is exposed to temperature change) of fully stabilized zirconia is very high and, especially, higher than that of non- or only partially stabilized zirconium dioxide so that the occurrence of a gap cannot be reduced if the tubular member consists of fully stabilized zirconia.

Surprisingly, in the context of the invention according to the present application, the inventors have found that the occurrence of a gap between the exchangeable nozzle and the upper nozzle can be reduced without or with only minimal deterioration of the refractory properties of the tubular member made of zirconia at the same time if the exchangeable nozzle comprises a tubular member made of partially stabilized, sintered zirconia, provided that the partially stabilized zirconia is partially stabilized by MgO, the partially stabilized zirconia has a degree of stabilization of not more than 26% by mass, and the tubular member further comprises free carbon.

Surprisingly, it was found that with a nozzle changer system of the aforementioned type during the casting of steel, a significantly reduced or practically no gap appears between the exchangeable nozzle and the upper nozzle if the exchangeable nozzle has such a tubular member (or "insert"). According to the inventors' studies, this is due to the fact that the tubular member of the invention's exchangeable nozzle remains almost unaffected by anomalous thermal expansion at the temperatures to which the exchangeable nozzle is subjected during the casting of steel. It has not yet been finally clarified what this is due to. However, in accordance with the invention, it turned out that the small change in volume only occurs if the tubular member has the specific combination of the features described above. The inventors assume that the free carbon further stabilizes the zirconia and that, hence, even though the zirconia is only partly stabilized the anomalous thermal expansion can be broadly suppressed. Further, as the zirconia is only partly stabilized, the amounts of stabilizing oxides in the zirconia are smaller than they would be in fully stabilized zirconia and, hence, the refractory properties of the tubular member, especially its corrosion resistance, is almost not influenced by this small amount of stabilizing oxides. Furthermore, the thermal expansion of the partially stabilized zirconia is smaller than that of fully stabilized zirconia.

The inventors of the present invention found out the anomalous thermal expansion of the tubular member can be no further suppressed if the degree of stabilization is above 26% by mass. However, as for a higher degree of stabilization higher amounts of stabilization oxides would be required and, hence, the refractory properties of the tubular member, especially its corrosion resistance, would be deteriorated and at the same time the thermal expansion of the partially stabilized zirconia would increase, the degree of stabilization of the zirconia is not above 26% by mass.

The tubular member of the exchangeable nozzle according to the invention consists of sintered zirconium dioxide partially stabilized by MgO, whereby the partially stabilized sintered zirconium dioxide has a degree of stabilization not exceeding 26% by mass. The degree of stabilization is known to denote the mass fraction of stabilized zirconia in relation to the total mass of zirconia. In this respect, a full stabilization of the zirconium dioxide is given at a degree of stabilization of 100% by mass. In accordance with the invention, it was found that the anomalous thermal expansion of the tubular member, especially at the temperatures in the tubular member prevailing during casting, i.e. especially at temperatures in the range from 1,000° C. to 1,300° C., can only slightly be increased if the degree of stabilization is above 15% by mass. Further, it has been found that the anomalous thermal expansion can be decreased strongly if the degree of stabilization is above 1% by mass, and even better if it is above 2% by mass and even still better if the degree of stabilization is above 3% by mass. According to a preferred embodiment, the partially stabilized, sintered zirconium dioxide therefore has a degree of stabilization in the range of 1 to 26% by mass, further preferred in the range of 2 to 20% by mass and especially preferred in the range of 3 to 15% by mass.

The degree of stabilization of the zirconia can be determined by X-ray diffraction (XRD), especially according to standard DIN EN 13925-2:2003-07.

The tubular member consists of partially stabilized, sintered zirconium dioxide, i.e. sintered particles or grains of zirconium dioxide. In this respect, the tubular member is a ceramic tubular member made of sintered zirconium dioxide. The partially stabilized, sintered zirconium dioxide preferably comprises a proportion of MgO in the range from 1 to 3% by mass, especially a proportion of MgO in the range from 1 to less than 3% by mass. In accordance with the invention, it was found that such a proportion of MgO in the partially stabilized, sintered zirconium dioxide could achieve a degree of stabilization of not more than 26% by mass, especially within the aforementioned ranges. The proportion of MgO in the partially stabilized, sintered zirconium dioxide is particularly preferred in the range from 1 to 2.8% by mass and even more preferred in the range from 1.2 to 2.6% by mass.

According to the invention, it has been established that only a slight change in volume of the tubular member can be present in case of degrees of stabilization above 26% by mass. However, to this end higher amounts of MgO in the zirconium dioxide are necessary, especially amounts of above 3% by mass, reducing the refractory properties, especially the corrosion resistance of the tubular member substantially.

The partially stabilized, sintered zirconium dioxide preferably comprises a content of $SiO_2$ not exceeding 1.5% by mass, even more preferred a content of $SiO_2$ below 1.5% by mass and even more preferred a content of $SiO_2$ below 1.2% by mass. Further, the partially stabilized, sintered zirconium dioxide preferably comprises a content of $SiO_2$ of at least 0.5% by mass.

Especially preferred, the partially stabilized, sintered zirconium dioxide comprises a content of $SiO_2$ in the range from 0.5 to 1.5% by mass, even more preferred in the range from 0.5 to 1.2% by mass. In accordance with the invention, it was determined that a degree of stabilization in accordance with the invention can be achieved by such proportions of $SiO_2$ in the partially stabilized, sintered zirconium dioxide with the aforementioned proportions of MgO.

The total mass of $ZrO_2$ and $HfO_2$ in the partially stabilized, sintered zirconium dioxide is preferably at least 92% by mass, even more preferably in the range of 92 to 98% by mass and even more preferably in the range of 94 to 97% by mass. It is well known that zirconium dioxide also regularly contains hafnium dioxide ($HfO_2$), as $HfO_2$ is difficult to separate from $ZrO_2$ in practice, so that, as usual, the total mass of $ZrO_2$ and $HfO_2$ in the partially stabilized, sintered zirconium dioxide is given here for the zirconium dioxide content in the partially stabilized, sintered zirconium dioxide.

In accordance with the invention, it was determined that a partially stabilized sintered zirconium dioxide in accordance with the invention can be made available if the $ZrO_2$+$HfO_2$ content in the partially stabilized, sintered zirconium dioxide is present in the aforementioned proportions in the partially stabilized, sintered zirconium dioxide, in particular if these proportions are present in combination with the aforementioned proportions of MgO and $SiO_2$.

Preferably the total mass of $ZrO_2$, $HfO_2$, MgO and $SiO_2$ in the partially stabilized, sintered zirconium dioxide is at least 98% by mass and even more preferably at least 99% by mass.

The information given herein on the mass proportions of MgO, $SiO_2$, $ZrO_2$ and $HfO_2$ in the partially stabilized, sintered zirconia is based on the total mass of the partially stabilized sintered zirconia.

The information given herein on the mass proportions of MgO, $SiO_2$, $ZrO_2$ and $HfO_2$ in the partially stabilized, sintered zirconium dioxide is in each case information on the chemical composition of the partially stabilized, sintered zirconium dioxide. The proportions of these oxides in the partially stabilized, sintered zirconium dioxide and the loss of ignition (LOI), i.e. the chemical composition of the partially stabilized, sintered zirconium dioxide and the loss of ignition, are determined by X-ray fluorescence analysis (XRF) in accordance with DIN EN ISO 12677:2013-02.

The tubular member of the invention's exchangeable nozzle comprises free carbon, i.e. carbon which is not bound.

Preferably, the free carbon is present (i.e. distributed) over the volume of the tubular member. According to a preferred embodiment, the free carbon is present on the surface and in the open pores of the tubular member. According to a particularly preferred embodiment, to provide such a tubular member comprising free carbon, the tubular member is impregnated with a carbon comprising impregnation, i.e. a carbon comprising impregnating agent, and heated afterwards such that, after heating, carbon of the carbon comprising impregnation remains in the tubular member as free carbon.

The carbon comprising impregnation may preferably be at least one of the following: pitch or tar. Particularly preferred, the carbon comprising impregnation is pitch, especially coal tar pitch. To impregnate the tubular member with the carbon comprising impregnation, the carbon comprising impregnation can be applied to the tubular member or poured on. According to a particularly preferred embodiment, in order to impregnate it with the carbon comprising impregnation, the tubular member is soaked with the carbon comprising impregnation.

Preferably the tubular member comprises free carbon in an amount in the range from 0.1 to 4.0% by mass. In accordance with the invention, it was found that the anomalous thermal expansion of the tubular member during casting, especially at the temperatures prevailing during casting in the range from 1,100° C. to 1,200° C., can be particularly strongly suppressed if the tubular member comprises free carbon in such a proportion. In accordance with the invention, it was found that the anomalous thermal expansion, especially in the aforementioned temperature interval, can be further reduced if the proportion of free carbon is increasingly approaching a proportion in the range from 1 to 2% by mass. It may therefore be particularly preferred that the tubular member comprises free carbon in an amount in the range from 0.5 to 3% by mass and even more preferably in an amount in the range from 1 to 2% by mass. The above-mentioned data in % by mass are in relation to the mass of the tubular member without the free carbon.

As explained above, it was found, in accordance with the invention, that the tubular member of the exchangeable nozzle in accordance with the invention has only a slight anomalous thermal expansion during the casting process, in particular also in the temperature range from 1,100° C. to 1,200° C. relevant for the casting of molten metal, in which zirconium dioxide also undergoes the phase transformation between its monoclinic low-temperature modification and its tetragonal high-temperature modification. In this respect, the difference in linear thermal expansion of the tubular member of the invention's exchangeable nozzle at 1,1000 and 1,200 C can be below 0.1 percentage points, in particular even below 0.05 percentage points. For example, a linear thermal expansion in the range from 0.75 to 0.80% at 1,100° C. as well at 1,200° C. could be determined for the tubular member of the exchangeable nozzle according to the invention. The difference between these values at 1,100° C. and 1,200° C. is a maximum of 0.05 percentage points. The linear thermal expansion is determined according to the standard DIN 51045-4:2007-01.

In addition, the tubular member of the exchangeable nozzle, in particular the geometry of the tubular member, can be designed according to the state of the art. Thus, the tubular member may extend along a longitudinal axis from a first end to a second end and may have an inner passageway extending through the tubular member along the longitudinal axis from the first end to the second end. The tubular member further comprises an inlet, opening into the inner passageway at the first end of the tubular member, and an outlet, opening into the inner passageway into the tubular member at the second end. In use, molten metal is conducted through the inner passageway of the tubular member, the molten metal entering the inner passageway at the inlet and exiting the inner passageway at the outlet. Thus, the tubular member can preferably be designed in the form of a tubular sleeve, preferably rotationally symmetrical to the longitudinal axis. Especially preferred is an inner passageway with a circular cross-section, preferably rotationally symmetric to the longitudinal axis. According to a particularly preferred embodiment, the cross-section of the inner passageway is constant along the longitudinal axis, so that the inner passageway as a whole has a circular-cylindrical shape. The wall of the tubular member preferably has a circular cylindrical outer contour or a conically changing outer contour.

The tubular member is preferably embedded in a refractory material, especially in a ceramic refractory material. This refractory material, in which the tubular material is embedded, can basically be any state-of-the-art refractory material for exchangeable nozzles. For example, it can be a refractory material based on alumina ($Al_2O_3$).

The tubular member embedded in a refractory material forms an exchangeable nozzle.

The refractory material can, as known from the state of the art, be at least partially covered on the outside by a metal shell.

One object of the invention is also a method for manufacturing an exchangeable nozzle, as disclosed herein, said method comprising the following steps:

Providing a tubular member, said tubular member extending along a longitudinal axis from a first end of said tubular member to a second end of said tubular member;

said tubular member further comprising:

an inner passageway, extending through said tubular member along said longitudinal axis from said first end of said tubular member to said second end of said tubular member;

an inlet, opening into said inner passageway at said first end of said tubular member; and an outlet, opening into said inner passageway at said second end of said tubular member;

said tubular member consisting of partly stabilized sintered zirconia;

said partly stabilized sintered zirconia being partly stabilized by MgO; and said partly stabilized sintered zirconia having a degree of stabilization not above 26% by mass;

said tubular member comprising free carbon.

The tubular member may have in particular the features as disclosed herein.

To provide that tubular member with free carbon, the tubular member can, as set forth above, be impregnated with a carbon comprising impregnation, wherein the technologies described above can be used, e.g. applying, pouring and especially preferred soaking.

After impregnation, the tubular member can be heated, especially tempered, preferably at temperatures in the range from 400 to 600° C., particularly preferably in the range from 450 to 550° C.

After impregnation and heating, the tubular member can be embedded in a refractory material, in particular a refractory material as described above. This results in an exchangeable nozzle.

Subsequently, the refractory material, as known from the state of the art, can be at least partially covered on the outside by a metal shell.

The exchangeable nozzle according to the invention, with or without a metal shell, can then be connected to an upper nozzle.

The exchangeable nozzle is detachably connected to an upper nozzle. The connection of the exchangeable nozzle according to the present invention to the upper nozzle can be based on the technologies known from the state of the art, in particular the nozzle changers known from the state of the art.

Accordingly, the exchangeable nozzle according to the present invention may be connectable to an upper nozzle of a nozzle changer system for billet casting, wherein said upper nozzle comprises an inner passageway for guiding molten metal through said upper nozzle and wherein said exchangeable nozzle is connectable such to said upper nozzle that, when said exchangeable nozzle is connected to said upper nozzle, said inner passageway of said upper nozzle and said inner passageway of said exchangeable nozzle form a continuous channel.

During billet casting, for example open casting, molten metal is chargeable through the continuous channel.

Further, an object of the present invention is a nozzle changer system for billet casting, especially for open casting, said nozzle changer system comprising the following:

An upper nozzle, said upper nozzle comprising an inner passageway for guiding molten metal through said upper nozzle;

an exchangeable nozzle according as disclosed herein;

wherein said exchangeable nozzle is exchangeable between a first position and a second position;

wherein in said first position, said exchangeable nozzle is connected to said upper nozzle such that said inner passageway of said upper nozzle and said inner passageway of said exchangeable nozzle form a continuous channel;

and wherein in said second position, said exchangeable nozzle is released from said upper nozzle.

The upper nozzle can be designed according to the state of the art, for example as described above. In this respect, the upper nozzle may preferably have a tubular member which forms the internal passageway of the upper nozzle and can form a continuous channel with the tubular member of the invented exchangeable nozzle in said first position.

In order to bring the exchangeable nozzle into the first and second position and to hold it in the respective position, it is possible to use the technologies known from the state of the art, in particular the nozzle changers known from the state of the art.

When the exchangeable nozzle is in the second position and detached from the upper nozzle, a new exchangeable nozzle can then be placed on the upper nozzle.

The object of the invention is also a tundish, which comprises the aforementioned nozzle changer system.

Further characteristics of the invention result from the claims, the attached figures, the following figure description and the following description of embodiments of the invention.

All features of the invention can, individually or in combination, combined with each other.

The attached FIGS. 1-3, strongly schematized, show an exemplary embodiment of the invention. FIGS. 4-8 also show measurement results for measuring the linear thermal expansion of tubular members for generic exchangeable nozzles.

In detail

Figure 1:
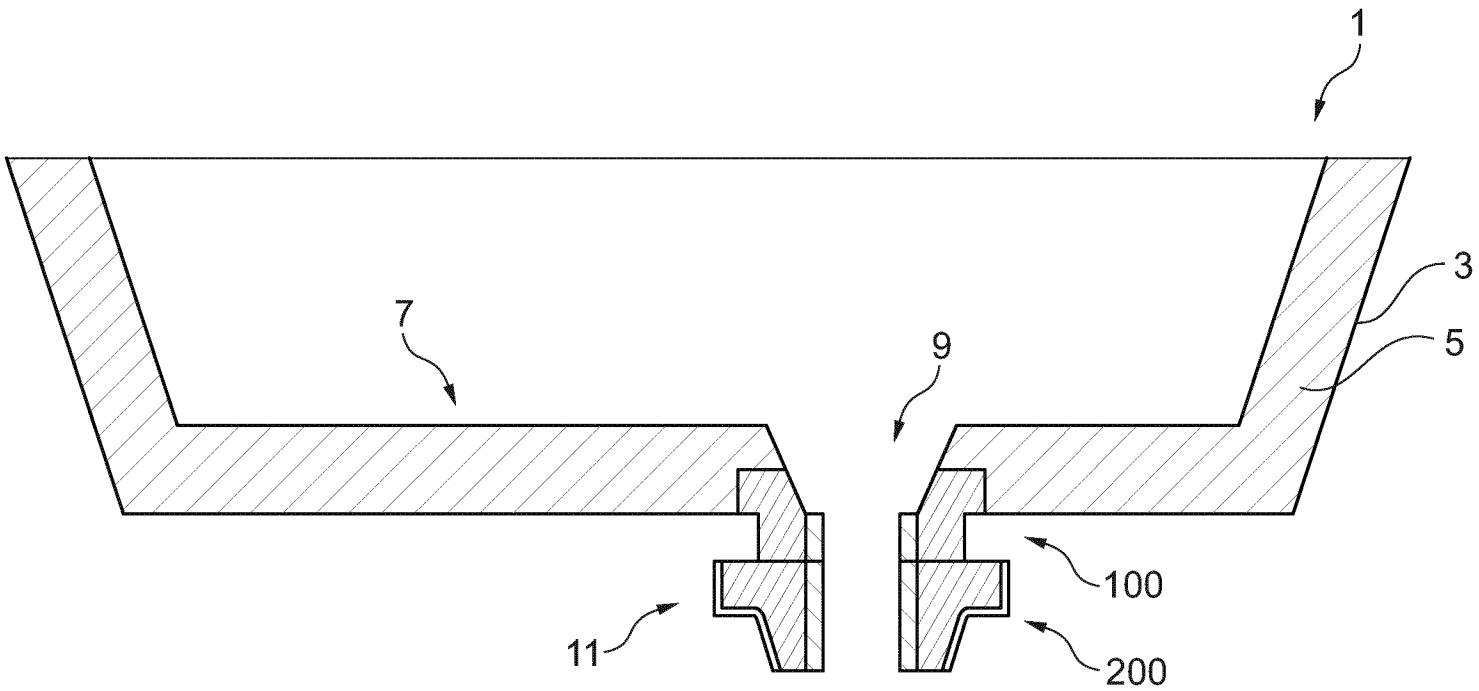
FIG. 1 shows a sectional view of an exemplary embodiment of a tundish according to the invention comprising a nozzle changer system according to the invention comprising an exchangeable nozzle according to the invention.

The tundish shown in FIG. 1 is marked in its entirety with the reference sign 1. Tundish 1 comprises, as is known from the state of the art, a metal vessel 3 lined on the inside with a refractory material 5. In the space enclosed by the refractory material 5, molten metal (not shown) can be provided. The tundish 1 is part of a continuous casting plant for continuous billet casting.

A spout 9 is provided at the bottom 7 of tundish 1, through which the molten metal provided in tundish 1 can be discharged into a mould (not shown) arranged below tundish 1.

The spout 9 is formed by an exemplary embodiment of nozzle changer system 11 according to the invention. The nozzle changer system 11 comprises an upper nozzle 100 permanently installed in the bottom 7 of the tundish 1 and an exchangeable nozzle 200. The exchangeable nozzle 200 is movable relative to the upper nozzle 100, as explained in detail below.

Figure 2:
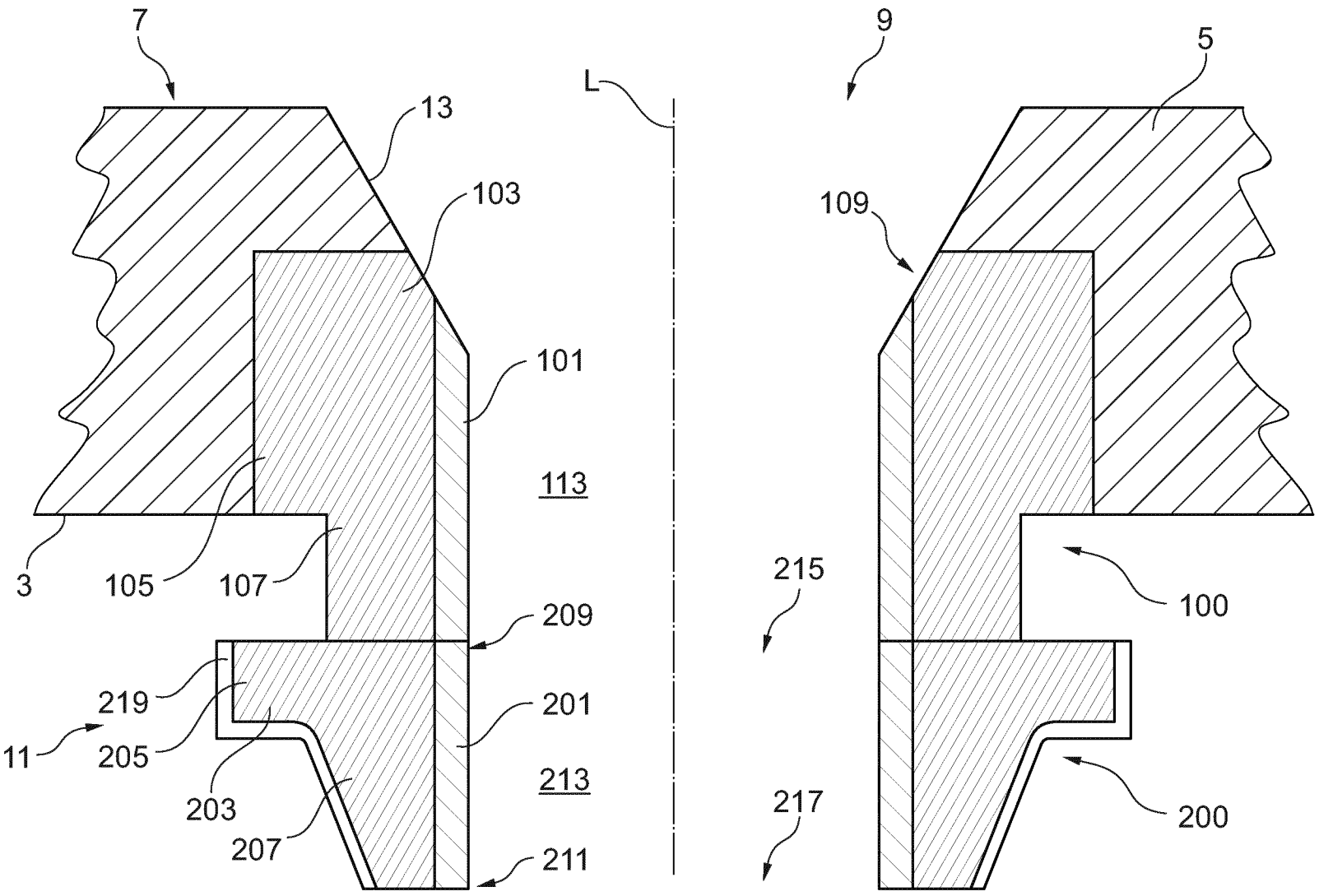
FIG. 2 shows a section of the view according to FIG. 1 in the area of the nozzle changer system.

FIG. 2 shows an enlarged view of the tundish 1 in the area of the nozzle changer system 11. The geometry of the nozzle changer system 11 and its arrangement at the bottom 7 of the tundish 1 correspond to the state of the art. In this respect, the upper nozzle 100 is essentially rotationally symmetrical in relation to a vertical longitudinal axis L. The upper nozzle 100 comprises a tubular member 101 made of a refractory material. The tubular member 101 is rotationally symmetrical to the longitudinal axis L, whereby the tubular member 101 has a constant wall thickness, so that the inner and outer contour of the tubular member 101 each has a circular cylindrical shape. The tubular member 101 is embedded in a refractory material 103 of the upper nozzle 100, wherein the refractory material 103 encompasses the tubular member 101 on the outside thereof. An upper section 105 of refractory material 103 is completely located in the bottom 7 of tundish 1. This upper section 105 has a circular-cylindrical outer contour rotationally symmetrical to the longitudinal axis L. A lower section 107 of the upper nozzle 100, adjacent to the upper section 105 below the upper section 105, protrudes above the bottom 7 of the tundish 1. This lower section 107 is also rotationally symmetrical to the longitudinal axis L and also has a circular-cylindrical outer contour. The lower section 107 has a smaller outer diameter than the upper section 105. At its upper end 109, the upper section 105 of the upper nozzle 100 expands conically outwards and merges into a section 12 in the bottom 7 of the tundish 1, which also expands conically upwards.

Below the upper nozzle 100, there is arranged an embodiment of an exchangeable nozzle 200 on the upper nozzle 100. The exchangeable nozzle 200 comprises a tubular member 201 which extends along the longitudinal axis L from a first (here upper) end 209 to a second (here lower) end 211. The tubular member 201 is rotationally symmetrical to the longitudinal axis L with a constant wall thickness, so that the inner and outer contour of the tubular element 201 each have a circular cylindrical shape. The tubular member 201 of the exchangeable nozzle 200 has the same inner diameter as the tubular member 101 of the upper nozzle 100. The tubular member 201 encloses an inner passageway 213 which extends from the first end 209 to the second end 211 along the longitudinal axis L through the tubular member 201. At first end 209, inlet 215 opens and at second end 211, outlet 217 opens into inner passageway 213.

The tubular member 101 of the upper nozzle 100 defines an inner passageway 113. At the position shown in FIG. 2, the longitudinal axes L of the tubular member 101 of the upper nozzle 100 and of the tubular member 201 of the exchangeable nozzle 200 are aligned. Since the tubular member 101 of the upper nozzle 100 and the tubular member 201 of the exchangeable nozzle 200 have the same inner diameter, the tubular member 101 and the tubular member 201 form a continuous channel with a constant inner diameter.

The tubular member 201 of the exchangeable nozzle 200 consists of sintered zirconium dioxide partially stabilized with MgO and has a degree of stabilization of 11.9%. Furthermore, the tubular member 201 comprises free carbon in an amount of 1.6 mass %. Therefore, the tubular member has been impregnated with a carbon comprising impregnation in the form of a coal tar pitch. For impregnation, the tubular member 201 was soaked with such pitch. Afterwards, the tubular member was tempered at 500° C. until the proportion of free carbon in the tubular element 201 amounts to 1.6 mass % (duration about 1 h), referred to the tubular element 201 without the free carbon.

The chemical composition of the tubular member 201, determined by X-ray fluorescence analysis (XRF) according to DIN EN ISO 12677:2013-02, is given in Table 1 below and designated E1T.

The tubular member 201 of the exchangeable nozzle 200 is completely surrounded on its outer circumference by a refractory material 203 and thus embedded in the refractory material 203. Refractory material 203 is a refractory ceramic casting compound based on alumina. The refractory material 203 is rotationally symmetrical to the longitudinal axis L and has an upper section 205 and an adjacent lower section 207. The upper section 205 has a circular cylindrical outer contour and the adjacent lower section 207 has a conically tapering outer contour. On its upper side, the upper section 205 is flat and runs perpendicular to the longitudinal axis L. The lower section 107 of the refractory material 103 of the upper nozzle 100 is also flat on its underside and runs perpendicular to the longitudinal axis L. In the example shown in FIGS. 1 and 2, the upper surface of the upper section 205 of the exchangeable nozzle 200 is in full contact with the lower surface of the lower section 107 of the upper nozzle 100, so that no gap is visible in the figures along this contact surface between the upper nozzle 100 and the exchangeable nozzle 200.

At its radial outer periphery, the refractory material 203 of the exchangeable nozzle 200 is enclosed by a metal shell 219.

The exchangeable nozzle 200 shown in the exemplary embodiment of the figures can be moved between a first and a second position. FIGS. 1 and 2 show the exchangeable nozzle 200 in the first position and FIG. 3 in the second position. In the first position shown in FIGS. 1 and 2, the inner passageway 113 of the upper nozzle 100 and the inner passageway 213 of the exchangeable nozzle 200 form a continuous channel as shown above. In the second position of the exchangeable nozzle 200 shown in FIG. 3, the exchangeable nozzle 200 is released from the upper nozzle 100.

In the first position of the exchangeable nozzle 200 shown in FIGS. 1 and 2, molten metal provided in tundish 1 can be discharged from tundish 1 through the continuous channel formed by inner passageway 113 and inner passage way 213 and poured into a mould located below tundish 1.

Figure 3:
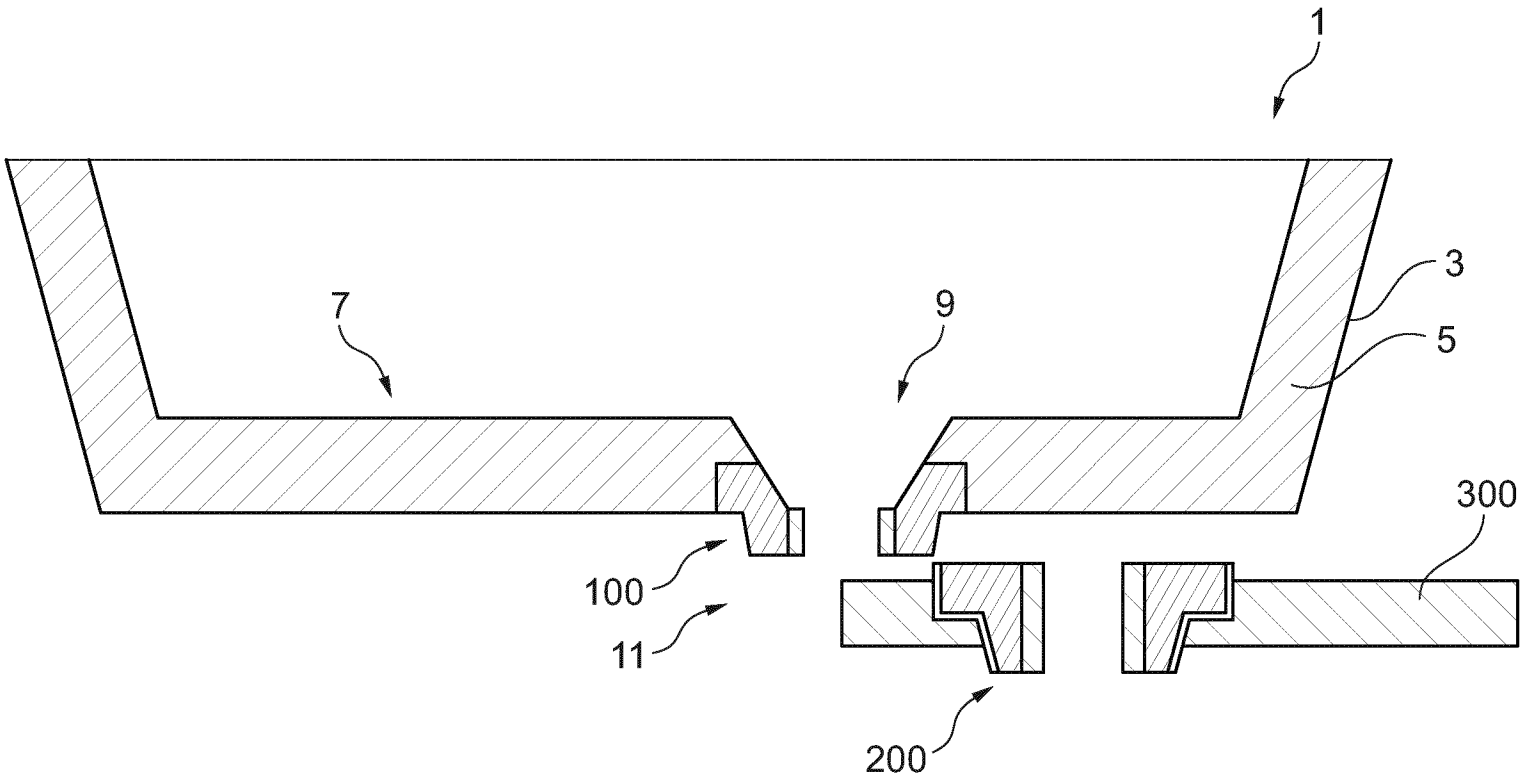
FIG. 3 shows the tundish according to FIG. 1, but with the exchangeable nozzle in a different position.

By means of a nozzle changer schematically shown in FIG. 3 and marked with the reference sign 300, the exchangeable nozzle 200 can be held in the first position shown in FIGS. 1 and 2 and can also be moved to the second position shown in FIG. 3, in which the exchangeable nozzle 200 is released from the upper nozzle 100. In this position, the exchangeable nozzle 200 can be removed from the nozzle changer 300 and exchanged by a new exchangeable nozzle. This new exchangeable nozzle can then be moved by the nozzle changer 300 to the first position shown in FIGS. 1 and 2.

Tests were carried out to determine the properties of tubular members for exchangeable nozzles. To produce the tubular members, powders of zirconium dioxide (grain size <40 μm), magnesia (<150 μm) and quartz flour as well as an organic binder were provided. The raw materials and the binder were then mixed together in different proportions, pressed into green bodies and then sintered by ceramic firing. Tubular members for an exchangeable nozzle were then obtained, which are designated E1, E2, E3 and E4 in Table 1 below and had the physical values and chemical compositions specified in Table 1. One of each of these tubular members E1, E2, E3 and E4 was then soaked with pitch and tempered, so that the tubular members designated in Table 1 as E1T, E2T, E3T and E4T were obtained, which each had a proportion of free carbon of about 1.6% by mass, based on the mass of the respective tubular member without the free carbon. The physical properties and chemical composition of the tubular members according to E1T, E2T, E3T and E4T are also given in Table 1.

The chemical composition of the free carbon comprising tubular members E1, E2, E3 and E4 and no free carbon comprising tubular members E1T, E2T, E3T and E4T was determined by X-ray fluorescence analysis (XRF) according to DIN EN ISO 12677:2013-02.

TABLE 1

| | E1 | E2 | E3 | E4 | E1T | E2T | E3T | E4T |
|---|---|---|---|---|---|---|---|---|
| Degree of stabilization [mass %] | 3.8 | 12.6 | 25.7 | >33 | 4.6 | 11.9 | 26.5 | 33.5 |
| Bulk density [g/cm$^3$] | 5.07 | 5.07 | 4.53 | 4.42 | 5.13 | 5.08 | 4.66 | 4.53 |
| Open porosity [volume %] | 10.7 | 10.5 | 20.8 | 20.9 | 5.6 | 6.1 | 10.6 | 10.5 |
| MgO [mass %] | 1.82 | 2.42 | 2.22 | 4.00 | 1.81 | 2.45 | 2.22 | 3.90 |
| $SiO_2$ [mass %] | 0.99 | 1.01 | 0.04 | 1.06 | 0.99 | 0.96 | 0.04 | 0.97 |
| $ZrO_2$ + $HfO_2$ [masse %] | 96.0 | 95.2 | 96.7 | 93.9 | 96.1 | 95.5 | 96.6 | 94.0 |
| LOI | 0.21 | 0.13 | 0.24 | 0.17 | 1.29 | 1.27 | 2.88 | 3.25 |

In Table 1, only the tubular members E1T and E2T correspond to tubular members in an exchangeable nozzle according to the invention.

The linear thermal expansion of the tubular members according to Table 1 was determined according to the standard DIN 51045-4:2007-01. The results of these tests are shown in FIGS. 4 to 8.

The linear thermal expansion for the temperature interval between room temperature and 1,500° C. was determined.

Figure 4:
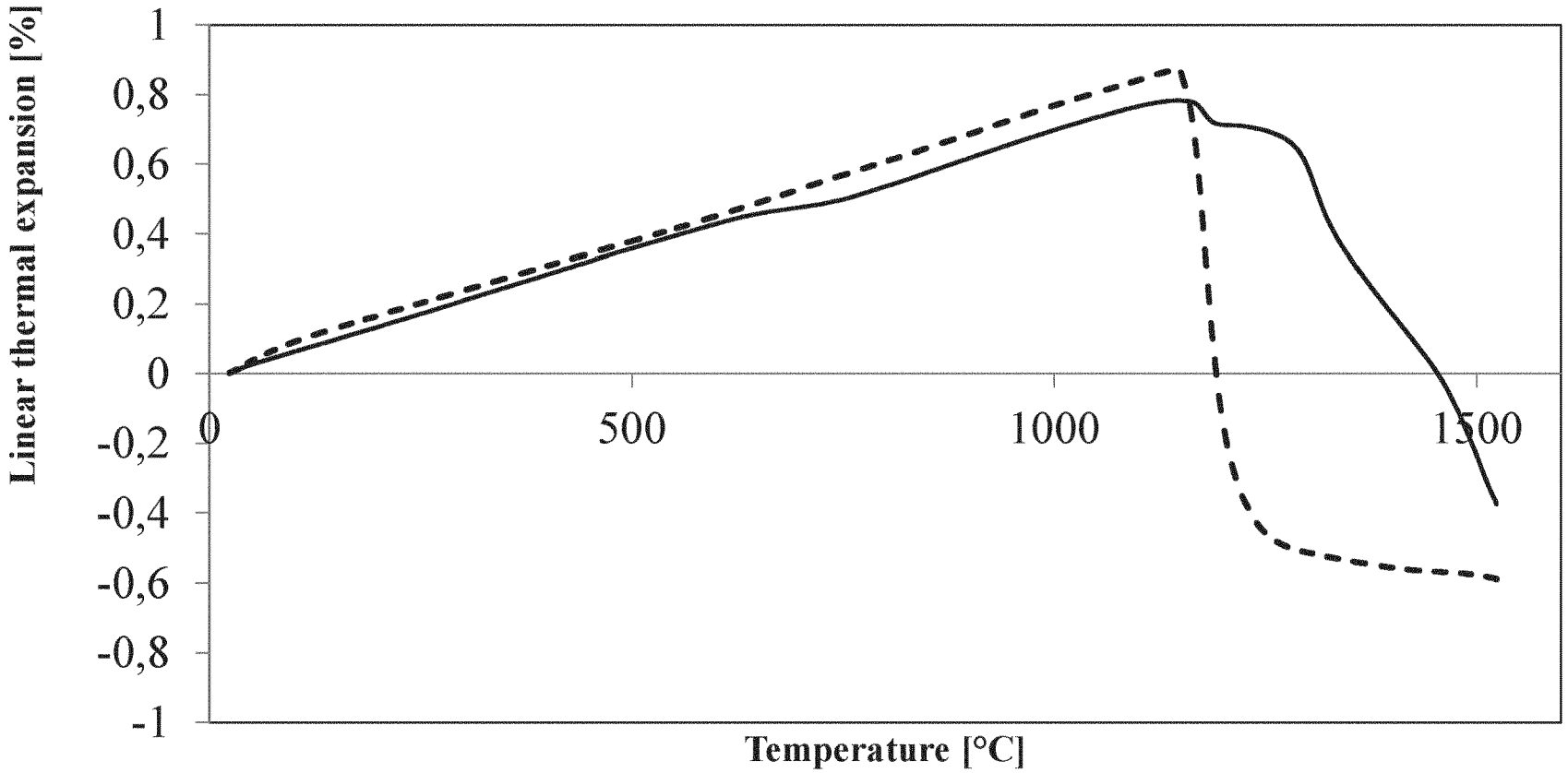
FIGS. 4-8 shows measurement results for measuring the linear thermal expansion of tubular members for generic exchangeable nozzles.

FIG. 4 shows the linear thermal expansion of the exchangeable nozzle E1T (solid line) and E1 (dashed line). It can be clearly seen that the linear thermal expansion of the tubular members E1 and E1T up to a temperature of just below 1,200° C. is similar. However, just below the temperature of 1,200° C., the linear thermal expansion of the tubular member E1 decreases abruptly.

The linear thermal expansion of the tubular member E1 changes from about 0.80% at 1,100° C. to about −0.20% at 1,200° C. and thus by about 1.00 percentage points in this temperature interval. In contrast, the linear thermal expansion of the tubular member E1T at 1,100° C. is about 0.77% and at 1,200° C. about 0.75%. In this respect, the difference in linear thermal expansion in this temperature interval for the tubular member E1T is only about 0.02 percentage points.

Figure 5:
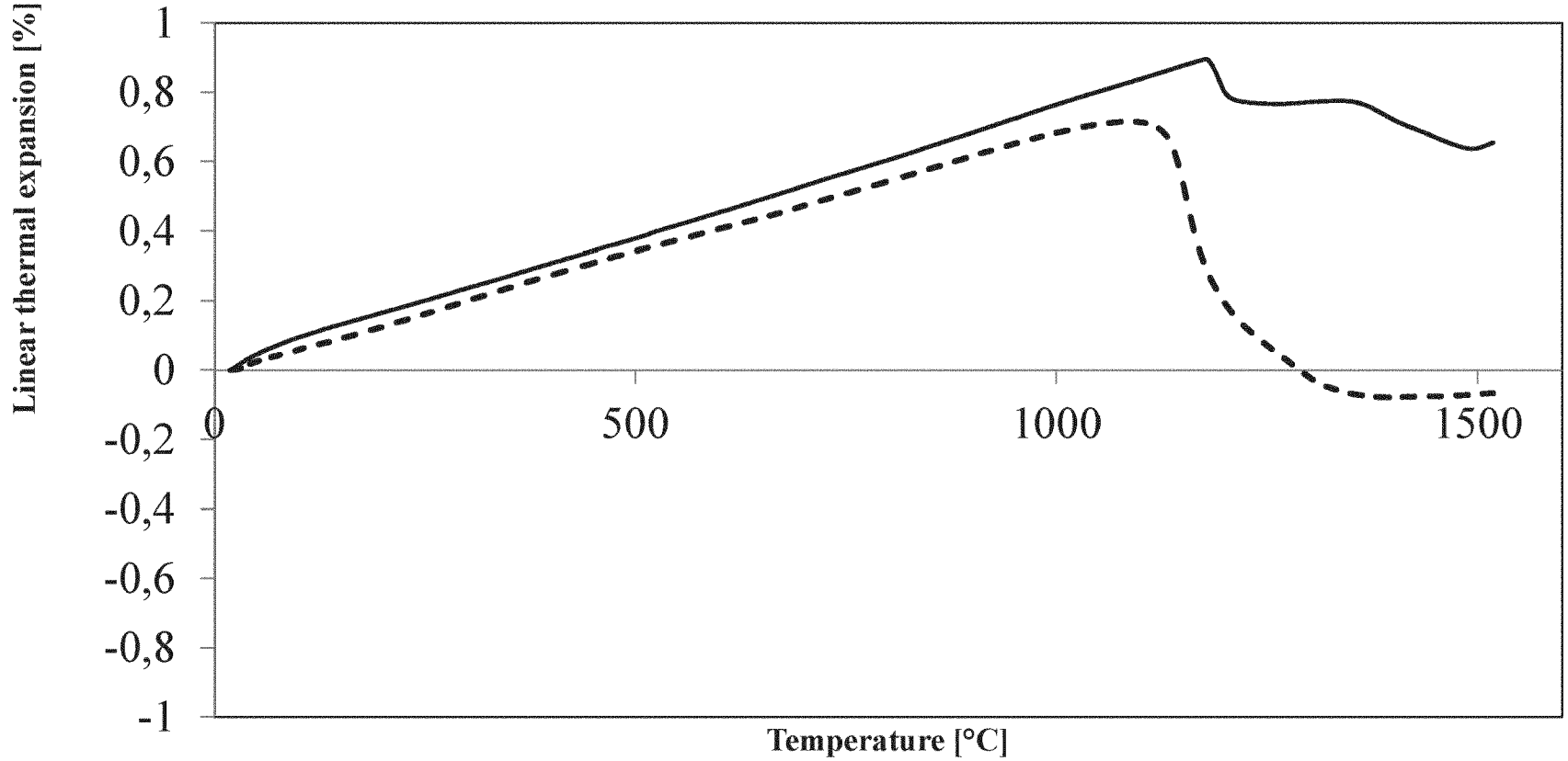

A similarly small change in the linear thermal expansion of the tubular member E2T is shown in FIG. 5, where the linear thermal expansion of the tubular member E2T is represented by a solid line and the tubular member E2 by a dashed line.

Figure 6:
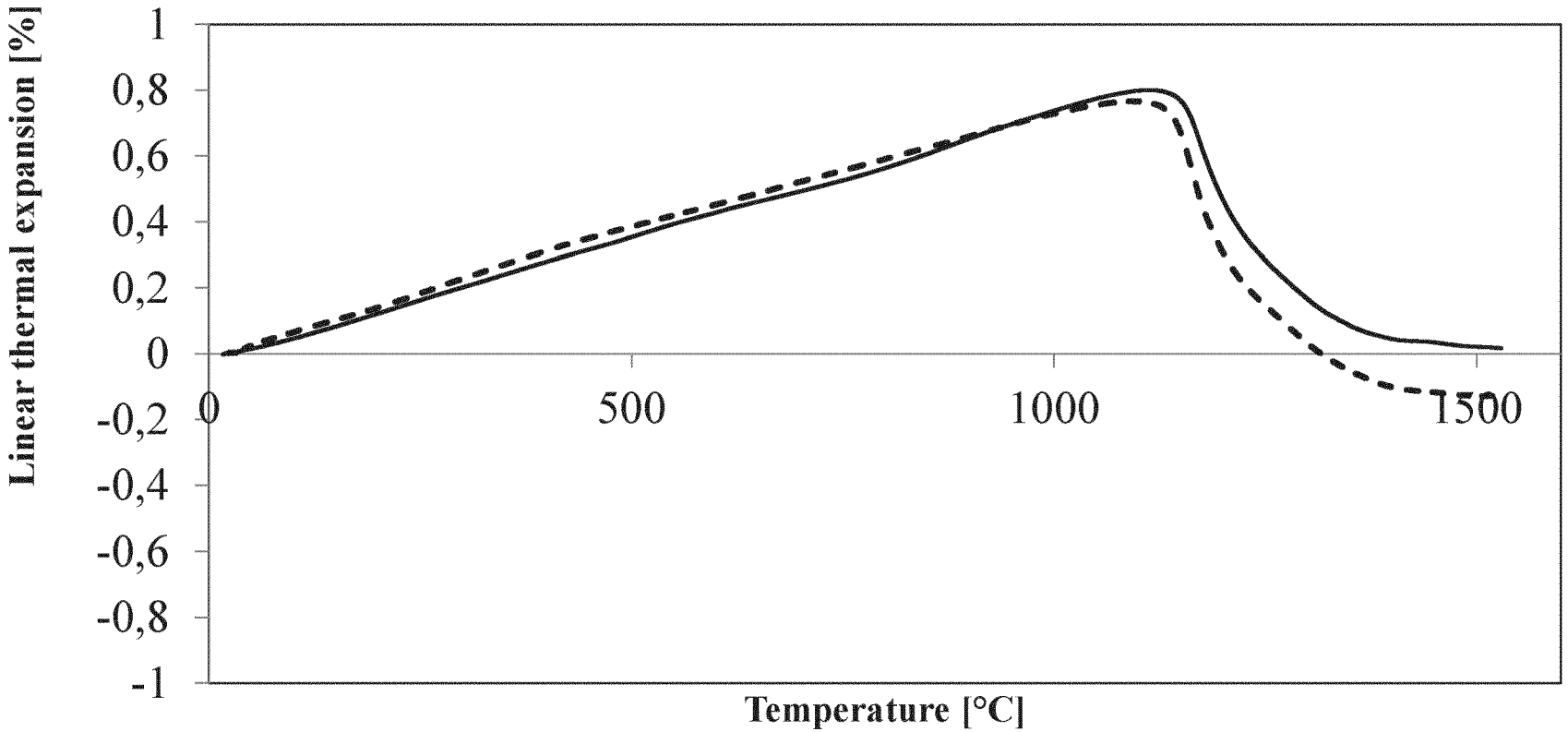

While the linear thermal expansion was measured in the experiments according to FIGS. 4, 5, 7 and 8 in an argon atmosphere, the measurement according to FIG. 6 was performed in an air atmosphere. The impregnation of the tubular member E2T oxidized completely. FIG. 6 clearly shows that in this case the tubular members E2 and E2T have generally the same linear thermal expansion.

Figure 7:
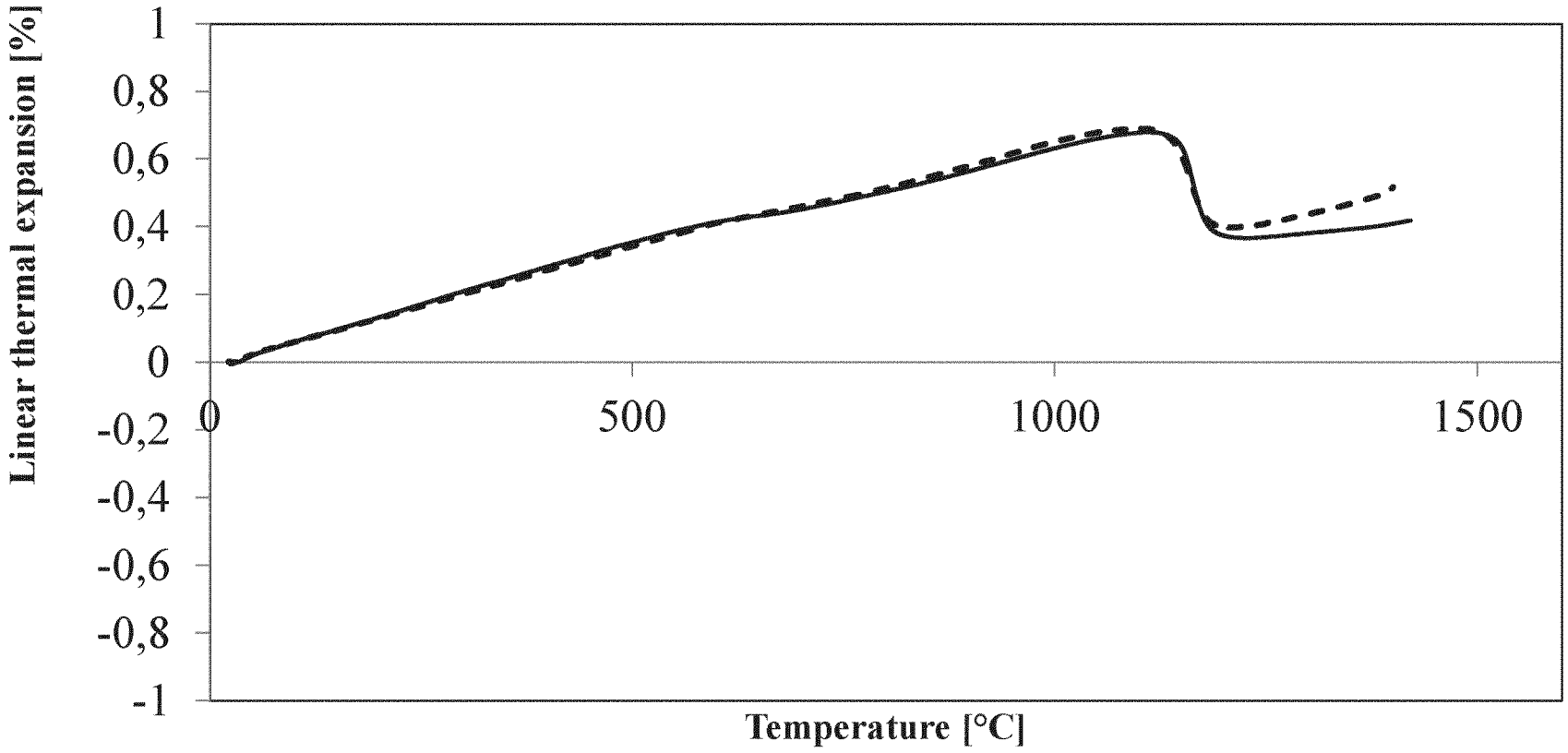

According to FIG. 7, the tubular member E3T (solid line) and E3 (dashed line) have generally the same linear thermal expansion.

Figure 8:
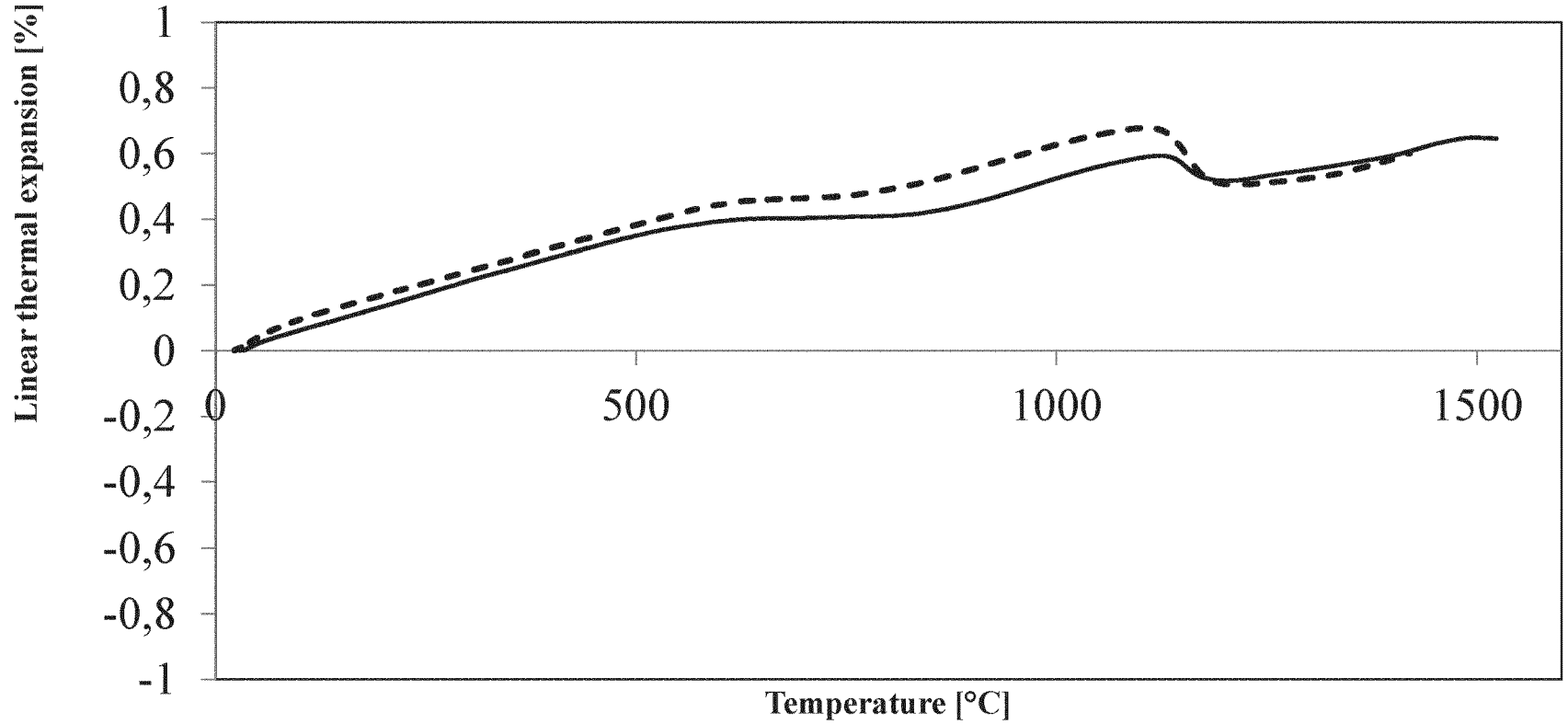

FIG. 8 also shows that the tubular member E4T (solid line) and E4 (dashed line) have generally the same linear thermal expansion.

As FIGS. 4 and 5 show, with a degree of stabilization of not more than 26% in the tubular member, a reduced change in linear thermal expansion, especially in the temperature interval between 1,100° C. and 1,200° C., can only be observed if the tubular members comprise free carbon in accordance with the invention.

If this free carbon is burnt out again, this reduced change in linear thermal expansion cannot be determined, as shown in FIG. 6.

FIG. 7 also shows that a reduction in linear thermal expansion in the tubular member can no longer be observed if the degree of stabilization is above 26%.

The invention claimed is:

1. An exchangeable nozzle (200) for a nozzle changer system (11) for billet casting, said exchangeable nozzle (200) comprising:

1.1 a tubular member (201);

1.1.1 said tubular member (201) extending along a longitudinal axis (L) from a first end (209) of said tubular member (201) to a second end (211) of said tubular member (201); said tubular member (201) comprising:

1.1.2 an inner passageway (213) extending through said tubular member (201) along said longitudinal axis (L) from said first end (209) of said tubular member (201) to said second end (211) of said tubular member (201);

1.1.3 an inlet (215) opening into said inner passageway (213) at said first end (209) of said tubular member (201); and 1.1.4 an outlet (217) opening into said inner passageway (213) at said second end (211) of said tubular member (201);

1.2 said tubular member (201) comprising partially stabilized sintered zirconia;

1.2.1 said partially stabilized sintered zirconia being partially stabilized by MgO; and 1.2.2 said partially stabilized sintered zirconia having a degree of stabilization not above 20% by mass; and 1.3 said tubular member (201) comprising free carbon.

2. The exchangeable nozzle (200) according to claim 1, said partially stabilized sintered zirconia having a degree of stabilization in the range from 2 to 20% by mass.

3. The exchangeable nozzle (200) according to claim 1, wherein the difference of linear thermal expansion of said tubular member (201) at 1,100° C. and 1,200° C. is below 0,1 percentage points.

4. The exchangeable nozzle (200) according to claim 1, said partially stabilized sintered zirconia having a MgO content in the range from 1 to 2.8% by mass.

5. The exchangeable nozzle (200) according to claim 1, said partially stabilized sintered zirconia having a $SiO_2$ content not above 1.5% by mass.

6. The exchangeable nozzle (200) according to claim 1, said partially stabilized sintered zirconia having a $ZrO_2$+ $HfO_2$ content of at least 92% by mass.

7. The exchangeable nozzle (200) according to claim 1, said partially stabilized sintered zirconia having a $ZrO_2$+ $HfO_2$ content in the range from 94 to 97% by mass.

8. The exchangeable nozzle (200) according to claim 1, said tubular member (201) comprising free carbon in an amount in the range from 0.1 to 4.0% by mass in relation to the mass of the tubular member (201) without said free carbon.

9. The exchangeable nozzle (200) according to claim 1, wherein said tubular member (201) is embedded in a ceramic refractory material (203).

10. The exchangeable nozzle (200) according to claim 1, wherein said ceramic refractory material (203) is at least partially covered by a metal shell (219).

11. The exchangeable nozzle (200) according to claim 1, said exchangeable nozzle (200) being connectable to an upper nozzle (100) of a nozzle changer system (11) for billet casting, wherein said upper nozzle (100) comprises an inner passageway (113) for guiding molten metal through said upper nozzle (100) and wherein said exchangeable nozzle (200) is connectable to said upper nozzle (100) such that, when said exchangeable nozzle (200) is connected to said upper nozzle (100), said inner passageway (113) of said upper nozzle (100) and said inner passageway (213) of said exchangeable nozzle (200) form a continuous channel.

12. A method for manufacturing an exchangeable nozzle, said method comprising the following steps:

13.1 providing a tubular member, 13.1.1 said tubular member extending along a longitudinal axis from a first end of said tubular member to a second end of said tubular member; said tubular member further comprising:

13.1.2 an inner passageway extending through said tubular member along said longitudinal axis from said first end of said tubular member to said second end of said tubular member;

13.1.3 an inlet opening into said inner passageway at said first end of said tubular member; and 13.1.4 an outlet opening into said inner passageway at said second end of said tubular member;

13.1.5 said tubular member comprising partly stabilized sintered zirconia;

13.1.6 said partly stabilized sintered zirconia being partly stabilized by MgO; and 13.1.7 said partly stabilized sintered zirconia having a degree of stabilization not above 20% by mass; and 13.2 impregnating said tubular member with a carbon containing impregnation.

13. A nozzle changer system (11) for billet casting, said nozzle changer system (11) comprising:

14.1 an upper nozzle (100), said upper nozzle (100) comprising an inner passageway (113) for guiding molten metal through said upper nozzle (100);

14.2 an exchangeable nozzle (200);

14.3 wherein said exchangeable nozzle (200) is exchangeable between a first position and a second position;

14.3.1 wherein in said first position, said exchangeable nozzle (200) is connected to said upper nozzle (100) such that said inner passageway (113) of said upper nozzle (100) and said inner passageway (213) of said exchangeable nozzle (200) form a continuous channel;

14.3.2 and wherein in said second position, said exchangeable nozzle (200) is released from said upper nozzle (100), wherein said exchangeable nozzle (200) comprises:

a tubular member (201);

said tubular member (201) extending along a longitudinal axis (L) from a first end (209) of said tubular member (201) to a second end (211) of said tubular member (201);

said tubular member (201) comprising:

an inner passageway (213) extending through said tubular member (201) along said longitudinal axis (L) from said first end (209) of said tubular member (201) to said second end (211) of said tubular member (201);

an inlet (215) opening into said inner passageway (213) at said first end (209) of said tubular member (201); and an outlet (217) opening into said inner passageway (213) at said second end (211) of said tubular member (201);

said tubular member (201) comprising partially stabilized sintered zirconia;

said partially stabilized sintered zirconia being partially stabilized by MgO; and said partially stabilized sintered zirconia having a degree of stabilization not above 20% by mass; and said tubular member (201) comprising free carbon.

14. A tundish (1) comprising a nozzle changer system (11) according to claim 13.

* * * * *